US008485399B2

(12) United States Patent
Raz

(10) Patent No.: US 8,485,399 B2
(45) Date of Patent: Jul. 16, 2013

(54) SLIDE VALVE FOR DRY GOODS

(75) Inventor: Richard Raz, Carol Stream, IL (US)

(73) Assignee: Snyder Industries, Inc., Lincoln, NE (US)

( * ) Notice: Subject to any disclaimer, the term of this patent is extended or adjusted under 35 U.S.C. 154(b) by 298 days.

(21) Appl. No.: 12/886,113

(22) Filed: Sep. 20, 2010

(65) Prior Publication Data

US 2012/0067927 A1 Mar. 22, 2012

(51) Int. Cl.
*B65D 47/00* (2006.01)
*B23P 19/10* (2006.01)

(52) U.S. Cl.
USPC ..... 222/561; 29/426.1

(58) Field of Classification Search
USPC 222/561, 185.1; 251/326–329, 367; 29/426.1
See application file for complete search history.

(56) References Cited

U.S. PATENT DOCUMENTS 5,229,824 A * 7/1993 Tsusaka et al. ..... 399/262
5,475,479 A * 12/1995 Hatakeyama et al. ..... 399/119
5,491,542 A * 2/1996 Nagashima et al. ..... 399/106
5,729,794 A * 3/1998 Schwallie et al. ..... 399/106
6,109,590 A * 8/2000 Koerner ..... 251/152
6,516,973 B2 * 2/2003 Chrisman et al. ..... 222/153.14
6,571,990 B2 * 6/2003 Bird ..... 222/185.1
2008/0029546 A1 * 2/2008 Schuld ..... 222/185.1

* cited by examiner

*Primary Examiner* — Paul R Durand
*Assistant Examiner* — Charles P Cheyney
(74) *Attorney, Agent, or Firm* — Hovey Williams LLP

(57) ABSTRACT

A slide valve assembly is provided for selectively dispensing dry goods from a hopper. The slide valve assembly is readily attached and detached from the hopper and is readily disassembled and reassembled to facilitate cleaning and/or servicing. Preferably, the slide valve assembly includes a panel secured to spaced support rails, a movable valve panel for opening and closing of the dispensing portion of the hopper, and a collar retainer for releasable attachment to the dispensing portion of a hopper. The slide valve assembly may be attached, detached, assembled, and disassembled substantially without the use of tools or separate fasteners, to minimize the risk of creating a contamination hazard for the goods dispensed from the hopper, while still allowing for secure attachment to the hopper.

16 Claims, 10 Drawing Sheets

SLIDE VALVE FOR DRY GOODS

FIELD OF THE INVENTION

The present invention is directed to a slide valve and, more specifically, to a slide valve for use in selectively dispensing dry goods from a hopper.

BACKGROUND OF THE INVENTION

Hoppers are frequently used for storage and dispensing of dry goods ranging from foodstuffs to chemicals, including powders and granular materials such as plastic resins, gravel, and sand, and are provided with a dispensing valve at the bottom of the hopper to control or limit the flow of the goods out of the hopper. However, typical slide valves can be difficult to remove and reinstall, which discourages operators from cleaning the valves on a regular basis. In addition, typical valves are assembled using rivets, bolts, or other mechanical fasteners that are prone to breakage or loosening during operation of the hopper and slide valve, which can lead to contamination of the dispensed dry goods with metal hardware.

SUMMARY OF THE INVENTION

The present invention provides a slide valve that is releasably coupled to a lower or dispensing end portion of a hopper. The slide valve may be readily coupled to the hopper and decoupled from the hopper to facilitate cleaning and/or servicing of the valve. Further, the slide valve is assembled from interlocking parts so that it can be readily disassembled without tools, and to substantially limit or prevent the possibility of pieces associated with the valve (such as loose fasteners or the like) coming loose and falling into the dry bulk goods that are dispensed from the hopper.

According to one form of the present invention, a slide valve for selectively dispensing dry bulk goods from a hopper includes at least one panel, a pair of spaced support rails, a movable valve panel, and a collar retainer. The at least one panel has opposite side portions to which the support rails releasably attach. The collar retainer is positioned adjacent the at least one panel and defines an opening for receiving a dispensing portion of a hopper, so that the collar retainer can releasably attach to the dispensing portion of the hopper. The movable valve panel is positioned between the support rails and is movable between an open position and a closed position. In the movable valve panel's open position, the dispensing portion of the hopper is at least partially unblocked by the movable valve panel, and in the movable valve panel's closed position, the dispensing portion of the hopper is substantially blocked by the movable valve panel.

In one aspect, the collar retainer is made up of a pair of substantially similar collar retainer halves, each of which defines approximately one-half of the opening of the collar retainer. The collar retainer halves are separable from one another to disengage the dispensing portion of the hopper.

In another aspect, the at least one panel includes at least one non-removable retaining element along each of the opposite side portions. Each of the support rails comprises at least one mounting element for securely and releasably engaging the non-removable retaining elements of the panel.

In yet another aspect, the at least one panel includes at least one resilient locking projection configured to releasably and lockably engage at least one of the support rails at the at least one mounting element.

In still another aspect, the at least one non-removable retaining element is a plurality of L-shaped projections along each side portion of the panel, and the at least one mounting element of the support rails is at least one row of apertures along each of the support rails. The apertures are configured to receive the L-shaped projections. Optionally, the L-shaped projections are unitarily formed with the at least one panel.

In a further aspect, the at least one panel includes an upper panel disposed above the movable valve panel, plus a lower panel disposed below the movable valve panel.

In another aspect, each of the support rails includes an upper channel and a lower channel, each for receiving a respective one of the opposite side portions of the upper panel and the lower panel, and each including a row of apertures for receiving the L-shaped projections of the upper panel and the lower panel.

Optionally, each of the support rails includes a middle flange between the upper channel and the lower channel, the middle flange for slidably engaging opposite side portions of the movable valve panel.

In a still further aspect, the slide valve includes a conduit that is removably positioned in an opening of the lower panel, the conduit in fluid communication with an opening of the upper panel and the dispensing portion of the hopper when the movable valve panel is in the open configuration. Optionally, the conduit is only removable from the lower panel when the upper panel has been removed from between the support rails and when the slide valve is detached from the hopper.

In still another aspect, the slide valve is combined with a hopper configured to store and dispense dry bulk goods.

According to another form of the present invention, a slide valve for selectively dispensing dry bulk goods from a hopper includes an upper panel, a lower panel spaced below the upper panel, a movable valve panel positioned between the upper panel and the lower panel, a collar retainer, and a pair of spaced support rails. The upper panel defines an opening and the lower panel defines an opening that is aligned with the opening of the upper panel. The collar retainer is positioned above the upper panel and defining an opening for receiving a dispensing portion of a hopper, the collar retainer configured to releasably attach to the dispensing portion of the hopper. Each of the support rails receives a respective opposite side portion of the upper panel and the lower panel. The movable valve panel is positionable between a closed position in which the openings of the upper and lower panels are substantially blocked, and an open configuration in which the openings of the upper and lower panels are at least partially unblocked.

In various aspect similar to those described above, the collar retainer may include a pair of substantially similar collar retainer halves, which optionally may include at least one resilient locking projection for releasably and lockably engaging at least one of the support rails. The upper panel and the lower panel may each include at least one non-removable retaining element, such as a plurality of L-shaped projections, along each opposite side portion thereof, while each of the support rails may include at least one mounting element, such as one or more apertures, for securely and releasably engaging the at least one non-removable retaining element along each opposite side portion of the upper panel and the lower panel. The upper panel and the lower panel may each further include at least one resilient locking projection for releasably and lockably engaging at least one of the support rails.

Optionally, each of the support rails defines an upper channel and a lower channel, each for receiving one of the opposite side portions of the upper panel and the lower panel, respectively. Each of the support rails may further include a middle flange, between the upper channel and the lower channel, for slidably engaging opposite side portions of the movable valve panel.

Optionally, the slide valve may include a conduit that is removably positioned in the opening of the lower panel. The conduit is in fluid communication with the opening of the upper panel and the dispensing portion of the hopper when the movable valve panel is in the open configuration. The conduit may be positioned so that is only removable from the lower panel when the upper panel has been removed from between the support rails and when the slide valve is detached from the hopper.

According to another form of the present invention, a method is provided for removing a slide valve from a hopper. The method includes providing a hopper with a dispensing portion, and providing a slide valve including an upper panel and a movable slide panel below the upper panel. Each of the panels is supported between a pair of support rails. A two-piece collar retainer is coupled between the support rails and disposed above the upper panel, the two-piece collar defining an opening for coupling to the dispensing portion of the hopper. A first piece of the two-piece collar is de-coupled from the support rails and from the dispensing portion of the hopper. The upper panel, the slide panel, and the support rails are then de-coupled from the dispensing portion of the hopper. Optionally, the upper panel, the slide panel, and the support rails may be de-coupled from the dispensing portion of the hopper, together as a unit. A second piece of the two-piece collar may optionally be de-coupled from the support rails prior to de-coupling the upper panel, the slide panel, and the support rails from the hopper.

Accordingly, the slide valve of the present invention provides a valve that is readily detached from a hopper, disassembled, reassembled, and reattached to a hopper to facilitate cleaning or servicing of the valve. The slide valve reduces or eliminates the risk of contaminating dry goods that are dispensed through the slide valve with loose pieces from the valve, and facilitates a method by which the slide valve is readily removed from a hopper and disassembled.

These and other objects, advantages, purposes and features of the invention will become more apparent upon review of the following specification in conjunction with the drawings.

DESCRIPTION OF THE PREFERRED EMBODIMENTS

Figure 1:
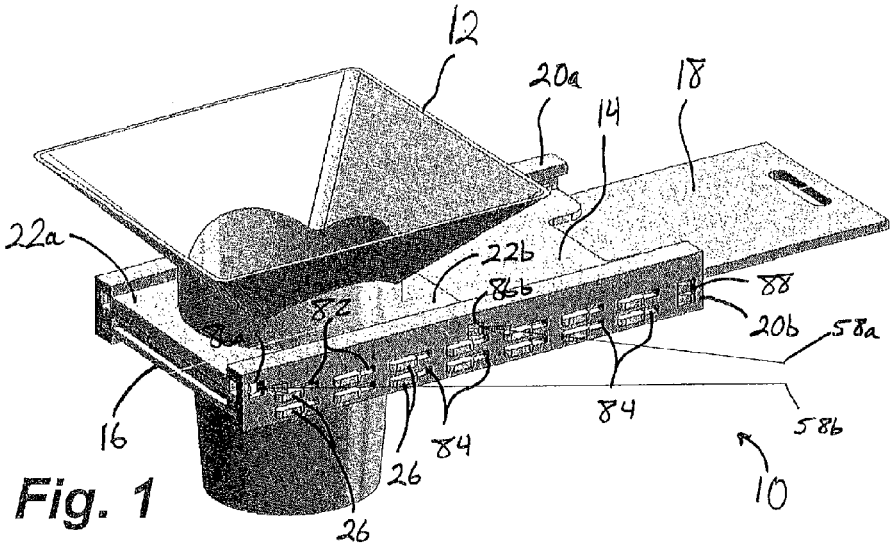
FIG. 1 is a perspective view of a slide valve assembly in accordance with the present invention, positioned at a lower end portion of a hopper.
Figure 2:
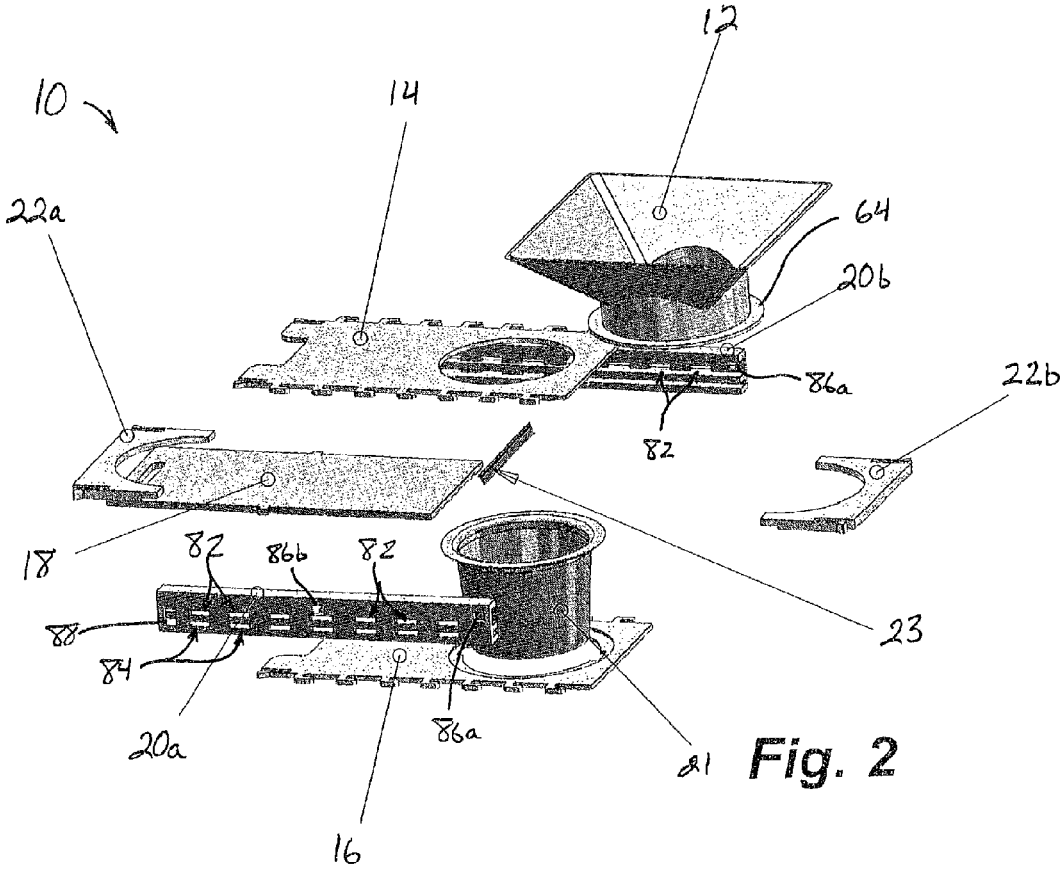
FIG. 2 is an exploded perspective view of the slide valve assembly of FIG. 1.

Referring now to the drawings and the illustrative embodiments depicted therein, a slide valve assembly 10 is installed at a hopper's lower dispensing portion 12 (FIG. 1). Slide valve assembly 10 includes an upper panel 14, a lower panel 16, and a movable valve panel 18, each supported between a pair of side or support rails 20*a*, 20*b* (FIGS. 1 and 2). Also supported between support rails 20*a*, 20*b* is a collar retainer made up of two collar retainer halves 22*a*, 22*b*, which are positioned above the upper panel 14 and which hold the slide valve assembly 10 to the lower end portion of the hopper 12, as will be described below. In the illustrated embodiment, an optional conduit 21 and dust seal 23 (FIG. 2) complete the slide valve assembly 10. Movable valve panel 18 is positionable between an open and extended position (FIGS. 1, 3, 4, 6-9, and 20A) and a closed and retracted position to selectively dispense dry goods out of hopper lower end portion 12 and through slide valve assembly 10. It will be appreciated that slide valve assembly 10 is made up of self-engaging components that may be readily disassembled from hopper lower end portion 12 and one another, and reassembled to each other and hopper lower end portion 12, all without using separate mechanical fasteners that could pose a contamination risk to the dispensed goods.

Figure 12:
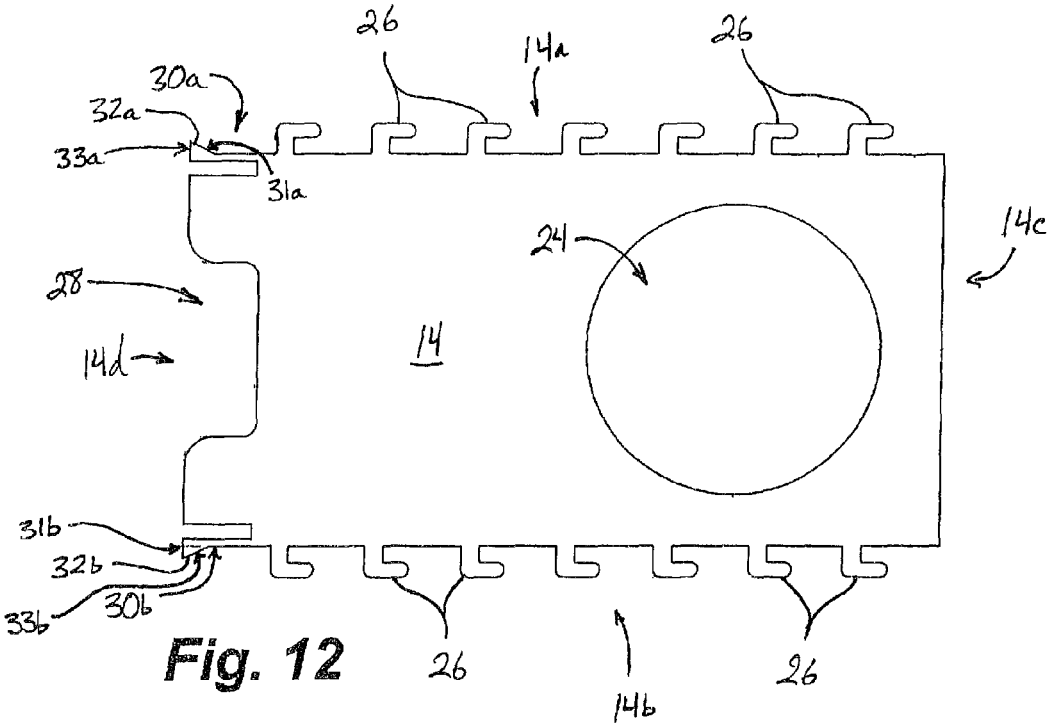
FIG. 12 is a top plan view of an upper panel of the slide valve assembly.

Upper panel 14 is generally rectangular in shape, including opposite side portions 14*a*, 14*b*, a distal end portion 14*c*, and a proximal end portion 14*d* (FIG. 12). Upper panel 14 is substantially planar and defines a circular opening 24 that is spaced evenly between side portions 14*a*, 14*b*, and that is positioned nearer to distal end portion 14*c*. A plurality of non-removable retaining elements, preferably in the form of L-shaped projections 26 that are integral and unitarily formed in one piece with side portions 14*a*, 14*b*, so as to extend from each of the side portions 14*a*, 14*b* of upper panel 14. L-shaped projections 26 extend outwardly away from the respective side portions 14*a*, 14*b* of the panel, and are shaped to lockably but releasably engage support rails 20*a*, 20*b*, as will be described below. Proximal end portion 14*d* defines a recess 28 that provides clearance for an operator's hand when operating movable valve panel 18.

Resilient locking projections 30*a*, 30*b* extend or project from respective opposite side portions 14*a*, 14*b* of the upper panel, in the vicinity of proximal end portion 14*d* (FIG. 12). Each locking projection 30*a*, 30*b* has, at its free end, an engaging portion 32*a*, 32*b* that releasably and lockably engages a respective support rail 20*a*, 20*b*. Engaging portions 30*a*, 30*b* each include a respective stop surface 31*a*, 31*b* that is substantially perpendicular to opposite side portions 14*a*, 14*b*, and a ramped surface 33*a*, 33*b* that is angled relative to opposite side portions 14*a*, 14*b* and proximal end portion 14*d*. Stop surfaces 31*a*, 31*b* are configured to contact portions of support rails 20*a*, 20*b* to limit or prevent movement of upper panel 14 in the direction faced by the stop surfaces. Ramped surfaces 33*a*, 33*b* allow upper panel 14 to be moved along the support rails in the opposite direction (i.e. in the direction of distal end portion 14*c*) during assembly of the slide valve by allowing locking projections 30*a*, 30*b* to deflect inwardly.

Figure 11:
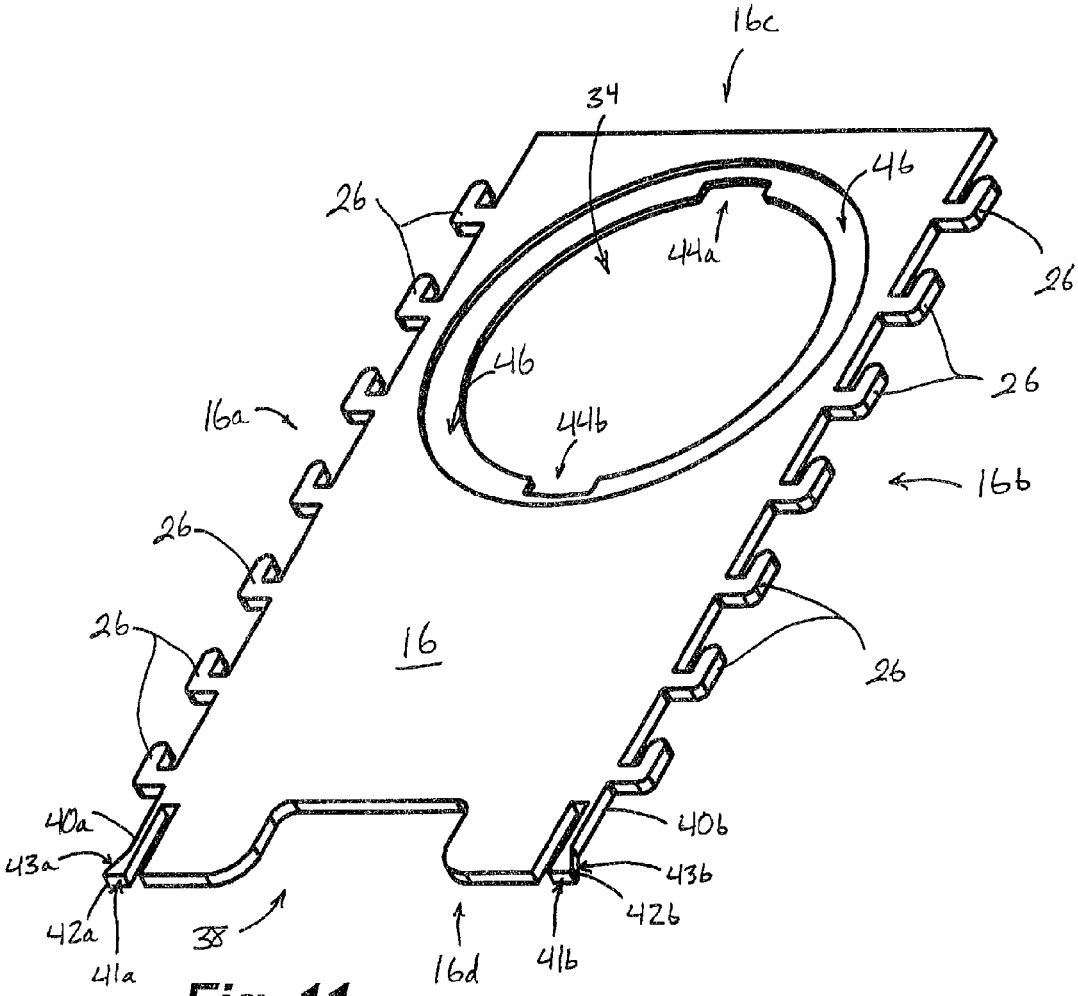
FIG. 11 is a perspective view of a lower panel of the slide valve assembly.

Lower panel 16 is substantially similar to upper panel 14, and includes opposite side portions 16*a*, 16*b*, a distal end portion 16*c*, and a proximal end portion 16*d* (FIG. 11). Lower panel 16 further defines a circular opening 34 that aligns with hopper lower end portion 12, a plurality of preferably L-shaped projections 36, a recess 28 at the proximal end portion 16*d*, and a pair of resilient locking projections 40*a*, 40*b* with engaging portions 42*a*, 42*b* having respective stop surfaces 41*a*, 41*b* and ramped surfaces 43*a*, 43*b*. Projections 36 are preferably integral and unitarily formed in one piece with lower panel 16 at side portions 16*a*, 16*b*. Opening 34 in lower panel 16 is substantially aligned with the opening 24 in upper panel 14 when slide valve assembly is fully assembled with upper panel 14 positioned directly above lower panel 16. Opening 34 is generally circular and includes a pair of notches 44*a*, 44*b* positioned across from one another. In addition, lower panel 16 defines a generally circular shelf portion 46 around the perimeter of opening 34, where the thickness of lower panel 16 is reduced. Notches 44*a*, 44*b* and circular shelf portion 46 facilitate supporting conduit 21, as will be described below.

Figure 13:
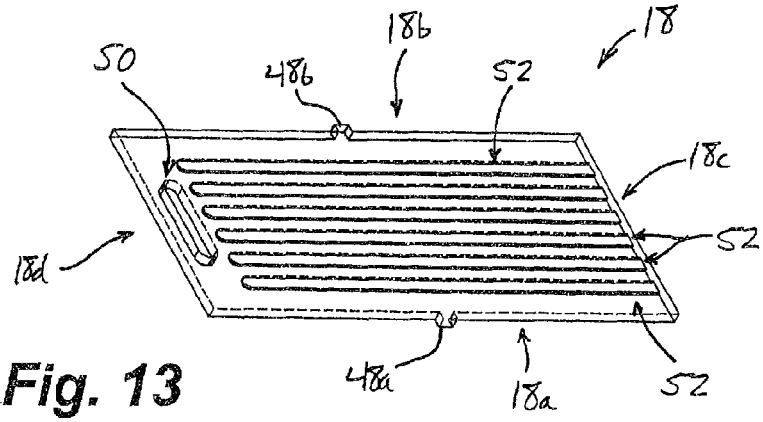
FIG. 13 is a bottom perspective view of a movable valve panel of the slide valve assembly.

Movable valve panel 18 is rectangular in shape and generally corresponds to the size and shape of upper panel 14 and lower panel 16, although valve panel 18 may be at least somewhat narrower in width, and without L-shaped projections, to provide adequate clearance between support rails 20*a*, 20*b* (FIG. 13). Much like upper panel 14 and lower panel 16, movable valve panel 18 includes opposite side portions 18*a*, 18*b*, a distal end portion 18*c*, and a proximal end portion 18*d*. Each of the opposite side portions 18*a*, 18*b* includes a single projection 48*a*, 48*b* extending outwardly in the plane of panel 18 for limiting the extent of travel of the movable valve panel 18 along the support rails 20*a*, 20*b*, as will be described below. Located at proximal end portion 18*d* is an opening 50 that provides a handle for grasping by an operator. The operator can grasp the movable valve panel 18 at the opening 50 and manually move the panel between an open position and a closed position by applying a pull or push force to the panel, respectively. In the illustrated embodiment, movable valve panel 18 includes a plurality of parallel grooves 52 in its lower surface, which grooves serve to reduce the friction of panel 18 as it slides along lower panel 16, on which movable valve panel 18 is supported. It will be appreciated that the movable valve panel could be actuated between opened and closed positions by a powered actuator, if desired, such as a pneumatic, hydraulic, or electric actuator, which could be controlled from a remote location.

Figure 5:
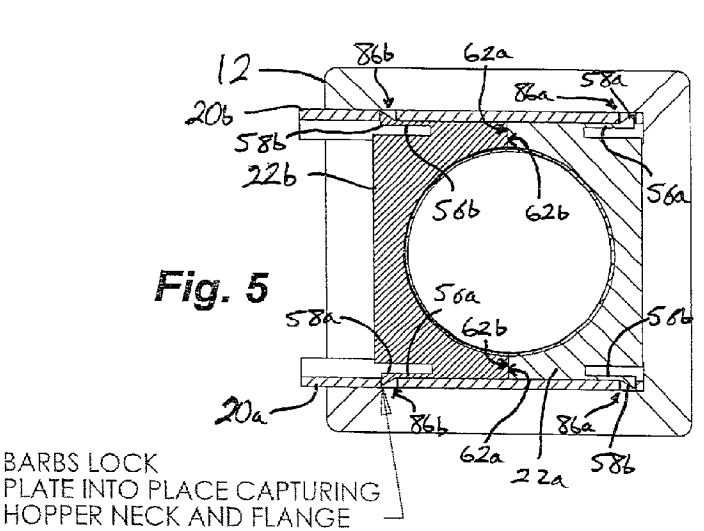
FIG. 5 is a sectional view of the slide valve assembly taken along section line V-V of FIG. 4.
Figure 3:
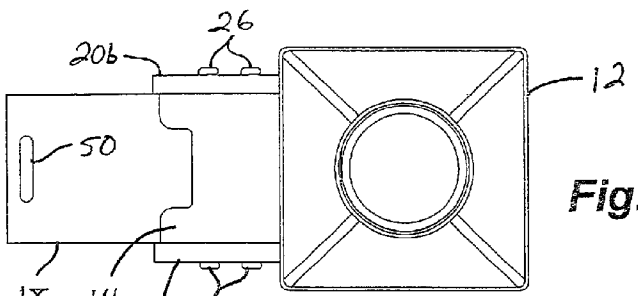
FIG. 3 is a top plan view of the slide valve assembly of FIG. 1.
Figure 4:
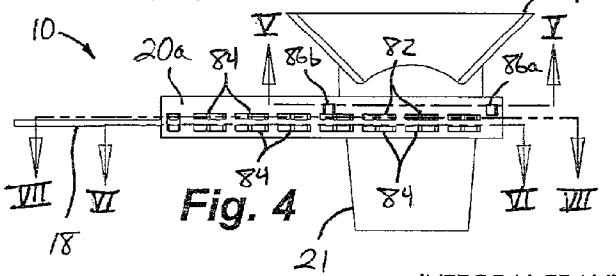
FIG. 4 is a side elevation of the slide valve assembly of FIG. 1.
Figure 14:
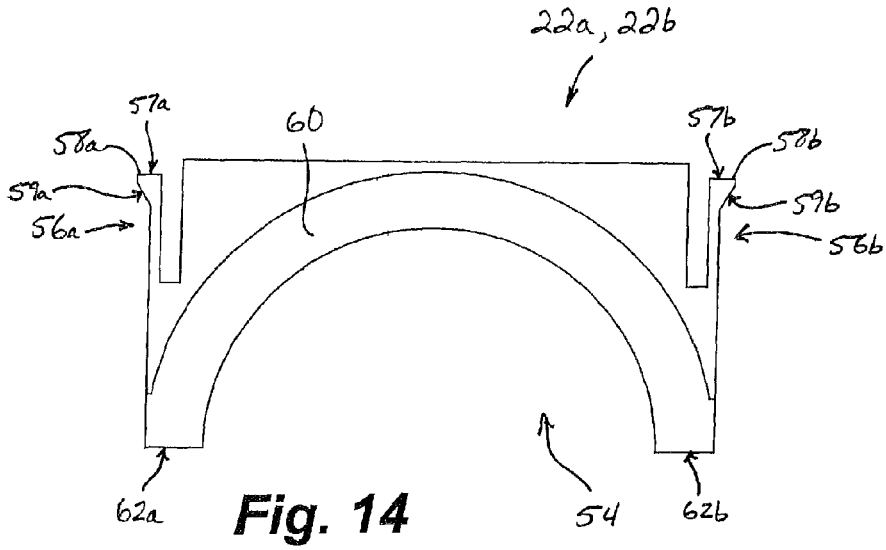
FIG. 14 is a top plan view of a collar retainer half of the slide valve assembly.

In the illustrated embodiment, the collar retainer that couples slide valve assembly 10 to hopper lower end portion 12 includes of a pair of collar retainer halves 22*a*, 22*b* that are substantially identical to one another (FIGS. 5 and 14). Each collar retainer half 22*a*, 22*b* includes a half-circular recess 54, a pair of resilient locking projections 56*a*, 56*b* with respective engaging portions 58*a*, 58*b*, and an arcuate section of reduced thickness 60 that surrounds half circular recess 54 (FIG. 14). Arcuate section 60 is dimensioned to receive one-half of a generally circular flange 64 (FIGS. 2 and 9) at the lower end portion of the hopper 12, to fixedly attach slide valve assembly 10 to the lower end portion of the hopper, such as best shown in FIGS. 1, 2, 9, and 10. Thus, collar retainer halves 22*a*, 22*b* cooperate to fully encircle and entrap the flange 64 of the hopper lower end portion 12, which holds slide valve assembly 10 fixed (except for movable valve panel 18) relative to hopper lower end portion 12. Each collar retainer half 22*a*, 22*b* includes a pair of distal end faces 62*a*, 62*b* that lie in close proximity to (or in abutment with) the corresponding distal end faces of the other collar retainer half 22*b*, 22*a* when slide valve assembly 10 is assembled, such as shown in FIG. 5.

Collar retainer halves 22*a*, 22*b* have substantially the same width as upper and lower panels 14, 16 (excluding L-shaped projections 26, 36), so that the collar retainer halves may be placed and retained between support rails 20*a*, 20*b*. Collar retainer halves 22*a*, 22*b* include resilient locking projections 56*a*, 56*b* that are configured to lockably but releasably engage respective ones of the support rails 20*a*, 20*b*, much like the resilient locking projections 40*a*, 40*b* and 30*a*, 30*b* of upper and lower panels 14, 16. Resilient locking projections 56*a*, 56*b* are flexible so that engaging portions 58*a*, 58*b* may be selectively disengaged from the support rails 20*a*, 20*b*, which allows one or both of collar retainer halves 22*a*, 22*b* to be removed from support rails 201, 20*b* such that support rails 20*a*, 20*b* may be removed or locked in place for detaching or attaching slide valve assembly 10 from the hopper lower end portion of hopper 12, or for allowing further disassembly of the slide valve assembly.

Figure 15:
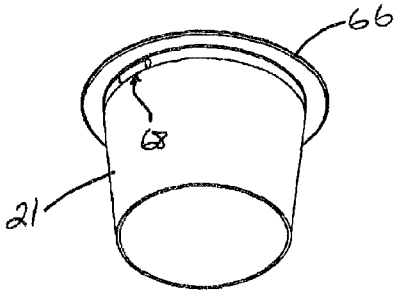
FIG. 15 is a bottom perspective view of a conduit of the slide valve assembly.

Conduit 21 is generally tubular in shape, with an upper flange 66 (FIGS. 6, 10, 15, and 16) that is supported at circular shelf portion 46 of lower panel 16. In addition, conduit 21 includes a pair of radial and partially-circumferential projections 68 spaced slightly below upper flange 66 (FIGS. 15 and 16), which are received in the notches 44*a*, 44*b* surrounding the opening 34 of lower panel 14 (FIG. 11). Projections 68 may be used to lock conduit 21 to lower panel 16, such as by rotating the conduit 21 relative to lower panel 16 so that circular shelf portion 46 is received in the space between projections 68 and upper flange 66. Optionally, projection 68 may simply rest in the respective notches 44*a*, 44*b* to limit or prevent rotation of conduit 21 relative to lower panel 16. In the illustrated embodiment, the lower tubular portion of conduit 21 is slightly funnel-shaped, having a narrower outlet than inlet, which facilitates the attachment of a container such as a bag, or which can be used to direct the flow of goods out of the hopper lower end portion 12.

Figure 17:
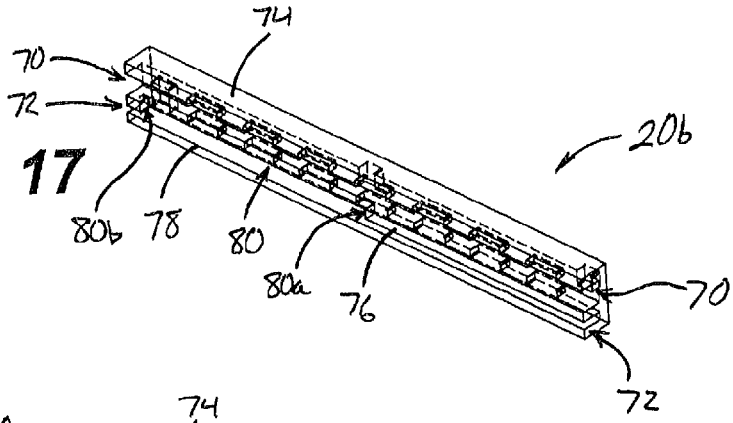
FIG. 17 is a perspective view of a support rail of the slide valve assembly, with portions shown in phantom.
Figure 18:
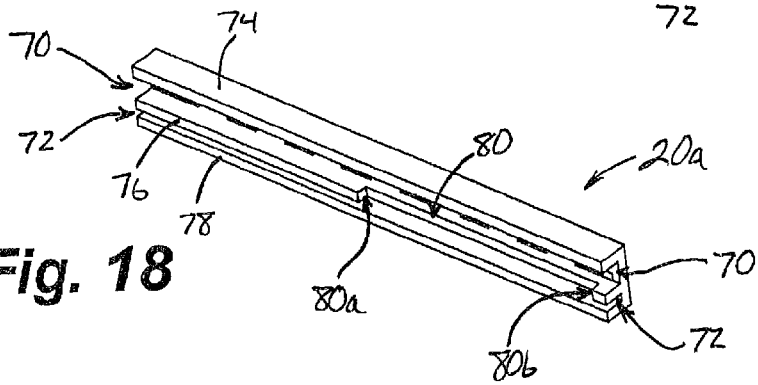
FIG. 18 is a perspective view of another support rail of the slide valve assembly.

Support rails 20*a*, 20*b* are substantially identical and formed in a mirror image of one another, such as shown in FIGS. 17 and 18. Each support rail 20*a*, 20*b* includes an upper longitudinal channel 70 for receiving upper panel 14 and collar retainer halves 22*a*, 22*b*, and a lower longitudinal channel 72 for receiving lower panel 16, which in turn supports conduit 21. Thus, each of the support rails 20*a*, 20*b* is generally E-shaped in cross section, with upper longitudinal channel 70 defined between an upper flange 74 and a middle flange 76, and with lower longitudinal channel 72 defined between middle flange 76 and a lower flange 78, all of which face inwardly when support rails 20*a*, 20*b* are assembled with slide valve assembly 10.

Figure 16:
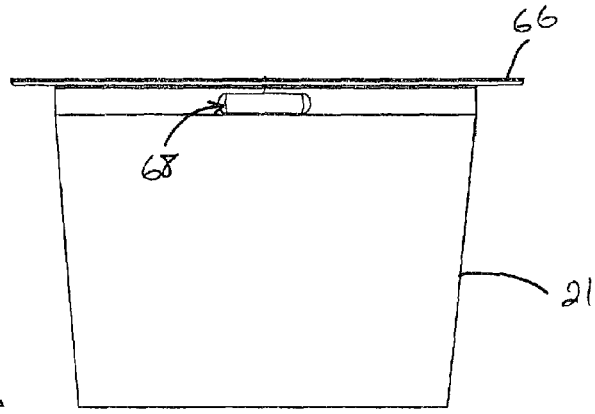
FIG. 16 is a side elevation of the conduit of FIG. 15.

The middle flanges 76 of support rails 20*a*, 20*b* each include an elongate notch 80, defined between a middle or distal end 80*a* and an opposite or proximal end 80*b*, the notch 80 extending along approximately one-half of the length of the middle flange 76. Thus, the elongate notches 80 are arranged generally toward the end of each support rail 20*a*, 20*b* that is away from conduit 21, and in the direction of handle 50 of movable valve panel 18 (FIGS. 16, 17, and 18). Elongate notches 80 receive the respective projections 48*a*, 48*b* of movable valve panel 18, and serve to limit the travel of movable valve panel 18 along support rails 20*a*, 20*b*. Thus, when movable valve panel 18 is pushed in fully to its closed position, projections 48*a*, 48*b* contact the middle or distal ends 80*a* defining elongate notch 80, and when the movable valve panel 18 is moved out to its fully open position, projections 48*a*, 48*b* contact the opposite or proximal end 80*b* of elongate notch 80. However, it will be appreciated that notches 80 and projections 48*a*, 48*b* could be positioned elsewhere and/or made with different dimensions, such as to change the travel limits of movable valve panel 18.

Figure 7:
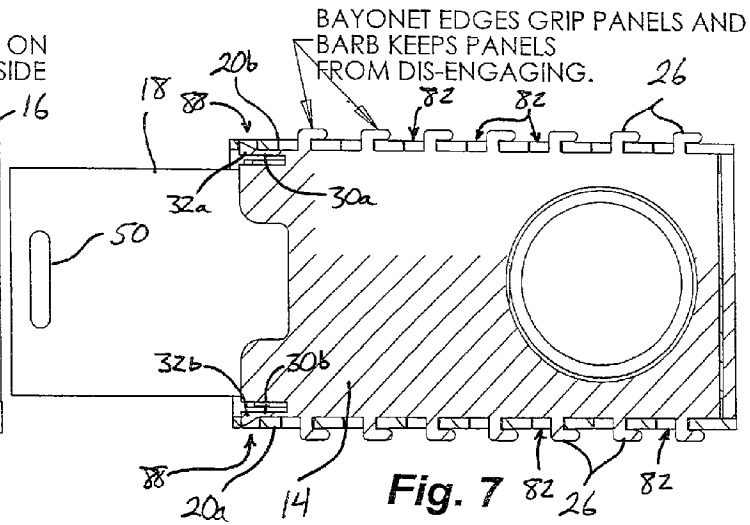
FIG. 7 is a sectional view of the slide valve assembly taken along section line VII-VII of FIG. 4.
Figure 6:
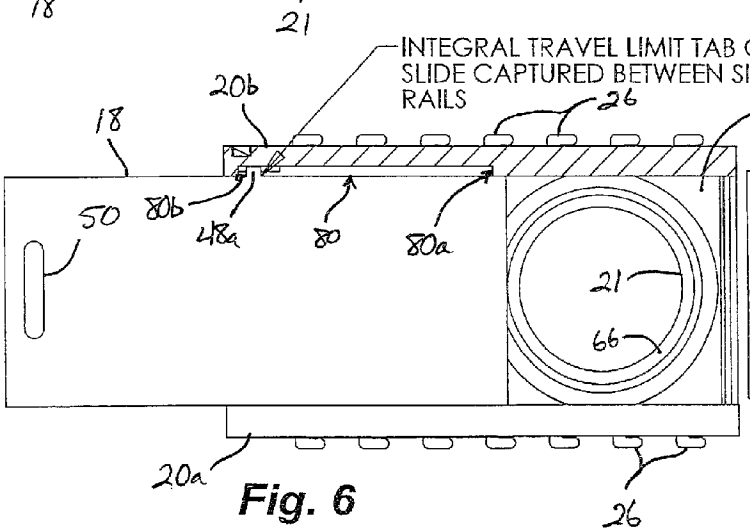
FIG. 6 is a sectional view of the slide valve assembly taken along section line VI-VI of FIG. 4.
Figure 8:
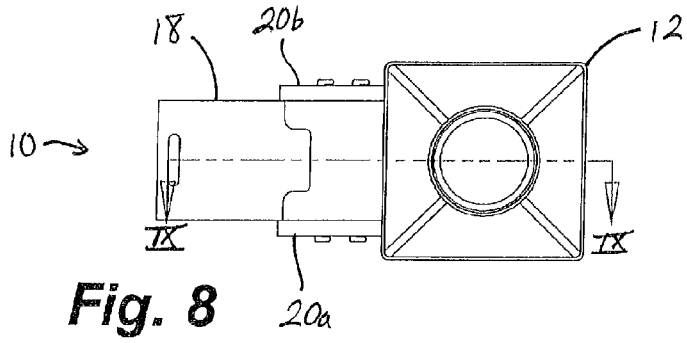
FIG. 8 is another top plan view of the slide valve assembly.
Figure 9:
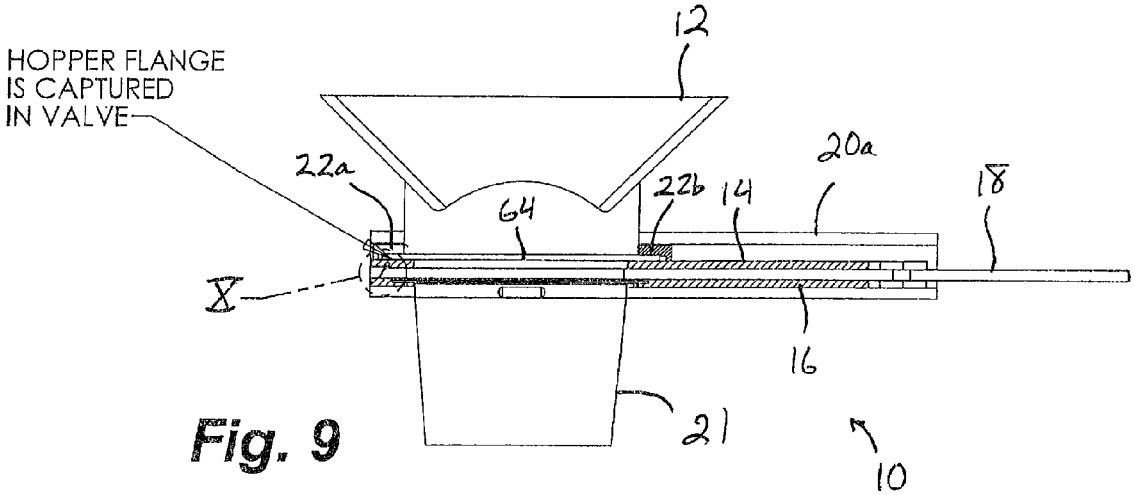
FIG. 9 is a section view of the slide valve assembly taken along section line IX-IX of FIG. 8.

Each support rail 20*a*, 20*b* includes a plurality of mounting elements in the form of an upper row of apertures 82 along upper longitudinal channel 70 and a lower row of apertures 84 along lower longitudinal channel 72 (FIGS. 1, 2, 4, and 7). Upper apertures 82 are spaced corresponding to the spacing of L-shaped projections 26 of upper panel 14, while lower apertures 84 are spaced corresponding to the L-shaped projections 36 of lower panel 16. Thus, upper apertures 82 configured to receive L-shaped projections 26 and lower apertures 84 are configured to receive L-shaped projections 36 during assembly of the slide valve assembly, such as shown in FIGS. 1 and 7.

In addition, each support rail 20*a*, 20*b* includes a pair of spaced upper openings 86*a*, 86*b* (FIGS. 1 and 2) for receiving the respective engaging portions 58*a*, 58*b* of the resilient locking projections 56*a*, 56*b* of collar retainer halves, 22*a*, 22*b*, such as shown in FIG. 5. Spaced upper openings 86*a*, 86*b* permit collar retainer halves 22*a*, 22*b* to be retained securely between support rails 20*a*, 20*b* unless and until resilient locking projections 56*a*, 56*b* are manually deflected to disengage the engaging portions 58*a*, 58*b* from spaced upper openings 86*a*, 86*b* of support rails 20*a*, 20*b*. Located at a proximal end of each support rail 20*a*, 20*b* is a panel lock opening or aperture 88 for receiving the engaging portions 32*a*, 32*b* and 42*a*, 42*b* of resilient locking projections 30*a*, 30*b* and 40*a*, 40*b* of upper panel 14 and lower panel 16, respectively. Thus, the engagement of engaging portions 32*a*, 32*b* and 42*a*, 42*b* with panel lock openings 88 in support rails 20*a*, 20*b* prevents the upper panel 14 and lower panel 16 from disengaging their respective L-shaped projections 36 from the respective upper apertures 82 and lower apertures 84, so that support rails 20*a*, 20*b* cannot be separated from upper panel 14 and lower panel 16 unless resilient locking projections 30*a*, 30*b* and 40*a*, 40*b* are first manually deflected inwardly to disengage the engaging portions 32*a*, 32*b* and 42*a*, 42*b* from panel lock openings 88 (FIGS. 1 and 7).

The main components of slide valve assembly 10, including upper panel 14, lower panel 16, movable valve panel 18, support rails 20*a*, 20*b*, collar retainer halves 22*a*, 22*b*, and conduit 21 may be made from metal or resinous material, or any other material that is sufficiently strong and rigid, and moisture or corrosion resistant, depending on the goods dispensed through the valve assembly, the operating environment, etc. For example, stainless steel approved for food contact may be used for dispensing grains or other foodstuffs, or resinous materials such as plastics or reinforced plastics may be used.

Figure 10:
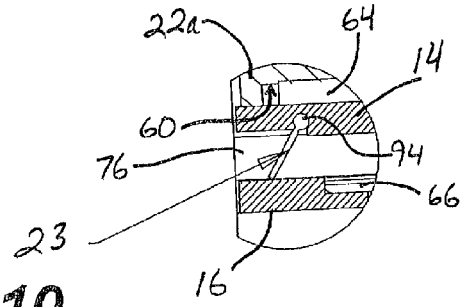
FIG. 10 is an enlarged view of the area designated X in FIG. 9.
Figure 19:
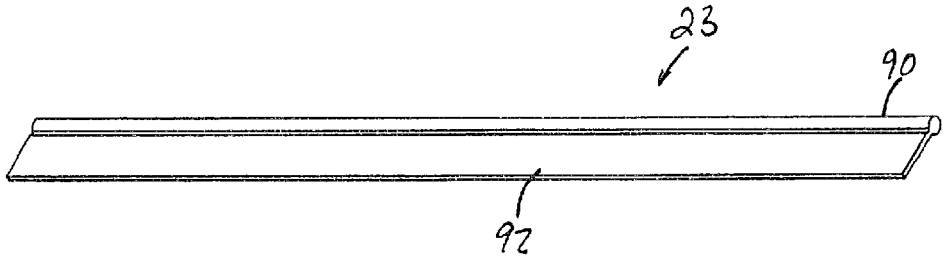
FIG. 19 is a perspective view of a dust seal of the slide valve assembly.

Optionally, and with reference to FIGS. 10 and 19, dust seal 23 may be provided above movable valve panel 18 to clean the top surface of the distal end portion 18*c* of the valve panel as the valve panel moves relative to dust seal 23 from the valve panel's open position to its closed position. Dust seal 23 also substantially seals or blocks the gap between upper panel 14 and lower panel 14 when movable valve panel 18 is in an open position, such as shown in FIG. 10, to limit or prevent the venting of dust from slide valve assembly 10 when dry goods are being dispensed through the valve. Dust seal 23 includes a mounting portion 90 and a generally planar flexible wiping portion 92 (FIG. 19). Mounting portion 90 is received in a correspondingly-shaped channel 94 at the lower surface of upper panel 14 (FIG. 10). Dust seal 23 may be made from essentially any sufficiently strong and resilient material, such as natural or synthetic rubber or the like, and provides the function of a squeegee or wiper as it traverses the upper surface of movable valve panel 18.

Accordingly, the present invention provides a slide valve for dispensing dry bulk goods from a hopper, the slide valve assembly made from mutually-engaging components, and preferably without the use of separate fasteners, so that the slide valve assembly can be readily removed from the hopper for cleaning, and can be readily disassembled and reassembled without the use of special tools. By avoiding the use of separate mechanical fasteners, the risk of any part of the slide valve assembly falling off and contaminating the goods is minimized.

Figure 20A:
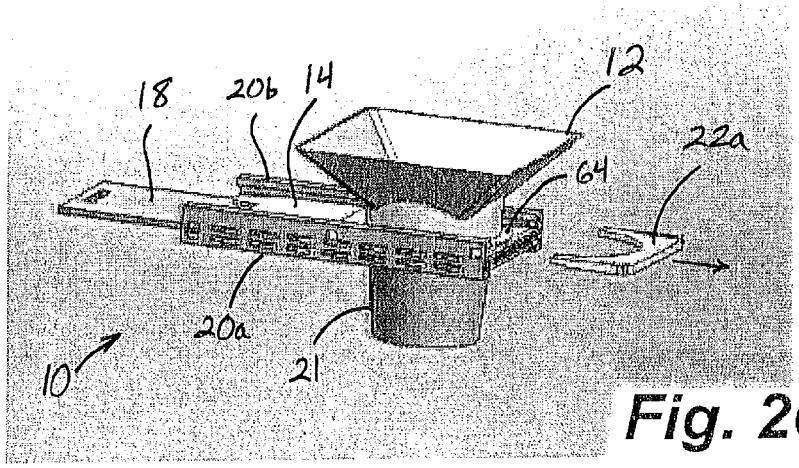
FIGS. 20A-I are perspective views of the slide valve assembly, depicting sequential steps of detaching the slide valve assembly from the dispensing portion of a hopper and disassembling the slide valve assembly until all of its components are separated from one another.

In addition, and with reference to FIGS. 20A-I, a method is provided for separating the slide valve assembly 10 from the hopper lower end portion 12, and for subsequently fully disassembling the slide valve assembly. Initially, slide valve assembly 10 may be fully assembled and attached to hopper lower end portion 12, such as shown in FIG. 1. To begin the process of separating slide valve assembly 10 from hopper lower end portion 12, engaging portions 58*a*, 58*b* of collar retainer half 22*a* are depressed inwardly against the biasing force of resilient locking projections 56*a*, 56*b* so that the engaging portions 58*a*, 58*b* (and, particularly, stop surfaces 51*a*, 51*b*) no longer engage the upper openings 86*a*, 86*b* of support rails 20*a*, 20*b* This permits removal of collar retainer half 22*a* by sliding it outwardly away from the hopper lower end portion 12 as shown in FIG. 20A.

Figure 20B:
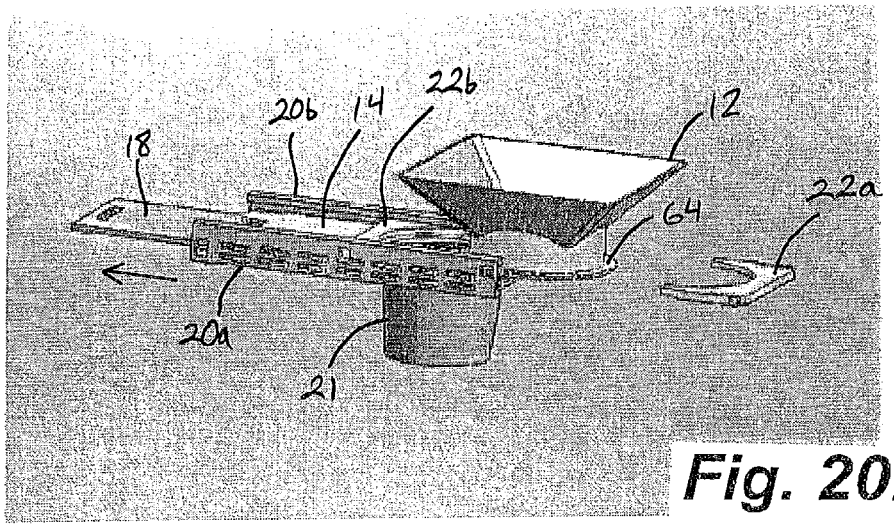
Figure 20C:
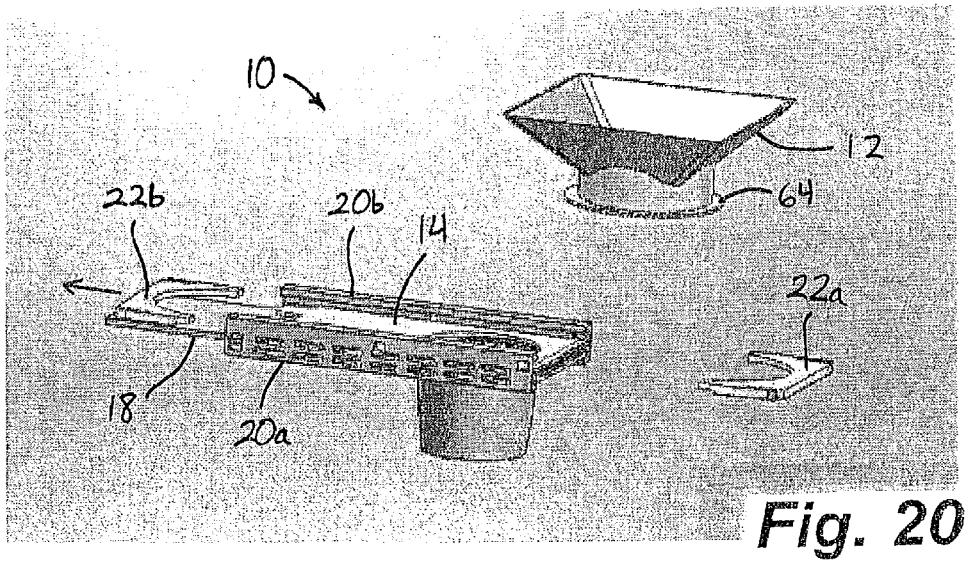

Once collar retainer half 22*a* has been removed, the slide valve assembly is no longer locked onto the hopper lower end portion 12, so that the remainder of the slide valve assembly may be moved or slid away from hopper lower end portion 12, such as shown in FIG. 20B. Alternatively, collar retainer half 22*b* could be slid or moved out of engagement with hopper lower end portion 12 in substantially the same manner as described above for the removal of collar retainer half 22*a*, either before or after (or simultaneously with) the removal of collar retainer 22*a*, such as to facilitate the removal of slide valve assembly 10 in a lateral direction opposite to that shown in FIG. 20B. Optionally, slide valve assembly 10 could be removed downwardly away from hopper lower end portion 12 by first removing both collar retainer halves 22*a*, 22*b*.

Figure 20D:
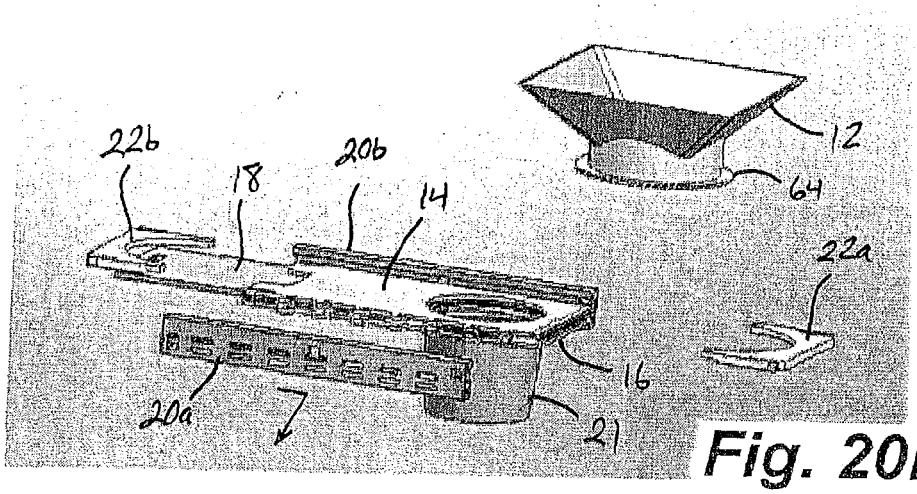
Figure 20E:
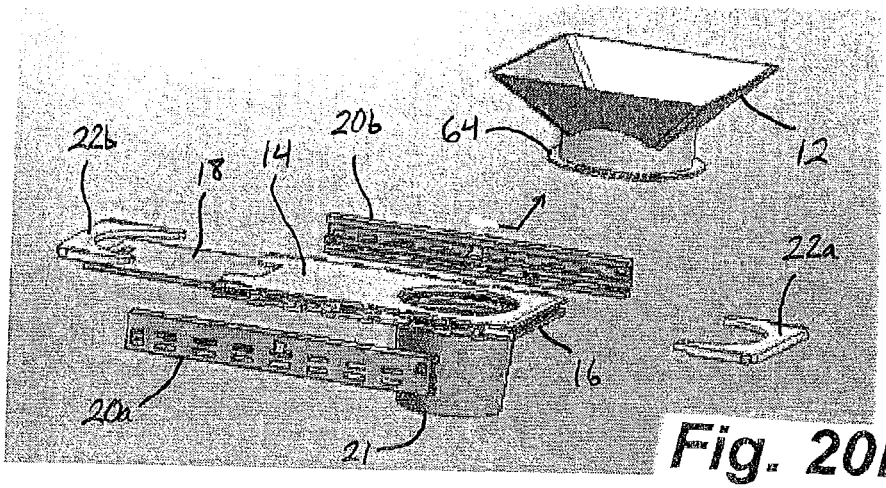

Once slide valve assembly 10 has been separated from hopper lower end portion 12, the remainder of the slide valve assembly may be fully disassembled, beginning with the removal of collar retainer half 22*b* (FIG. 20C), if it has not been removed previously. Once both collar retainer halves 22*a*, 22*b* have been removed, support rails 20*a*, 20*b* are removed either simultaneously or one at a time, such as shown in FIGS. 20*d* and 20*e*. As discussed above, support rails 20*a*, 20*b* are held in fixed positions along upper panel 14 and lower panel 16 via locking engagement of L-shaped projections 26, 36 with upper apertures 82 and lower apertures 84. Movement of support rails 20*a*, 20*b* relative to upper panel 14 and lower pane 16 is normally precluded by the engagement of engaging portions 32*a*, 32*b* and 42*a*, 42*b* of resilient locking projections 30*a*, 30*b* and 40*a*, 40*b* with the panel lock opening or aperture 88 of each support rail 20*a*, 20*b*. Thus, to separate the support rail 20*a*, 20*b* from upper panel 14 and lower panel 16, the engaging portions 32*a*, 32*b* and 42*a*, 42*b* are manually depressed inwardly until they disengage panel lock opening 88, so that support rails 20*a*, 20*b* may be initially slid along the side portions of upper panel 14 and lower panel 16 and then pulled away from the panels (as shown by jogged arrows in FIGS. 20D and 20E) to disengage L-shaped projections 26, 36 from upper apertures 82 and lower apertures 84.

Figure 20F:
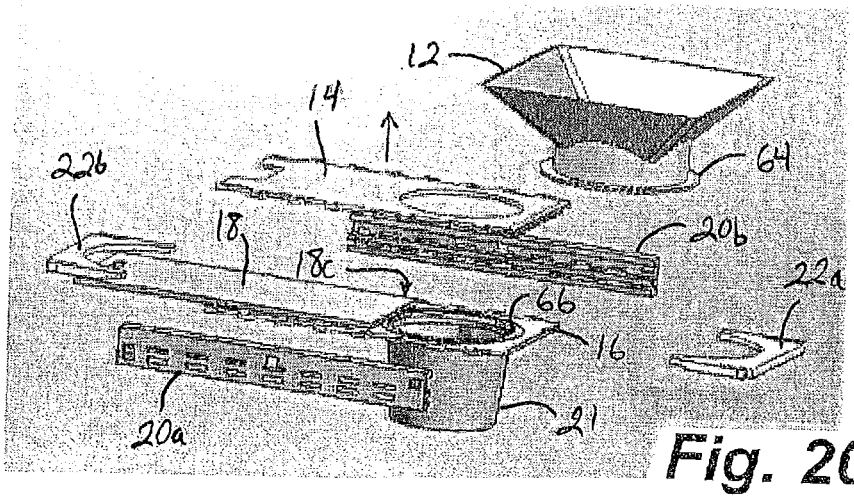
Figure 20G:
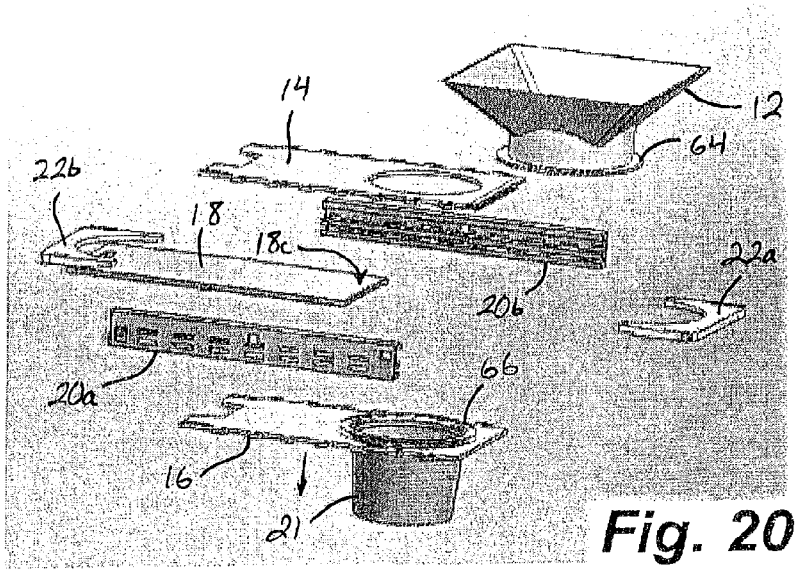
Figure 20H:
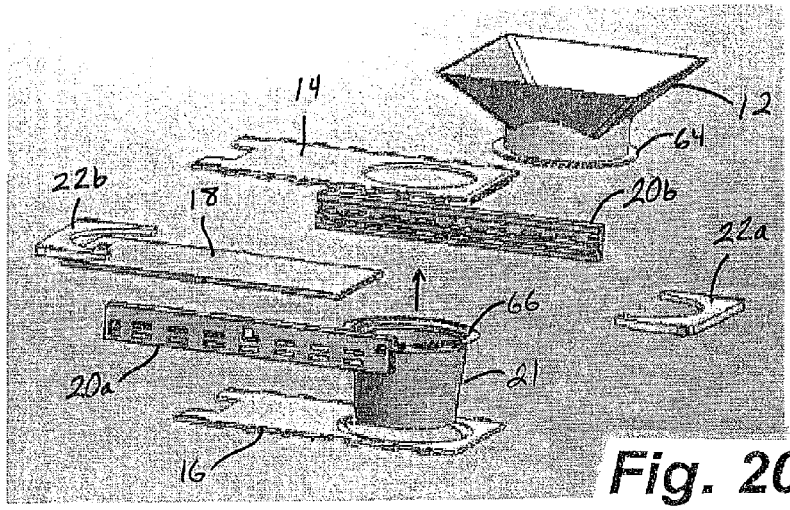
Figure 20I:
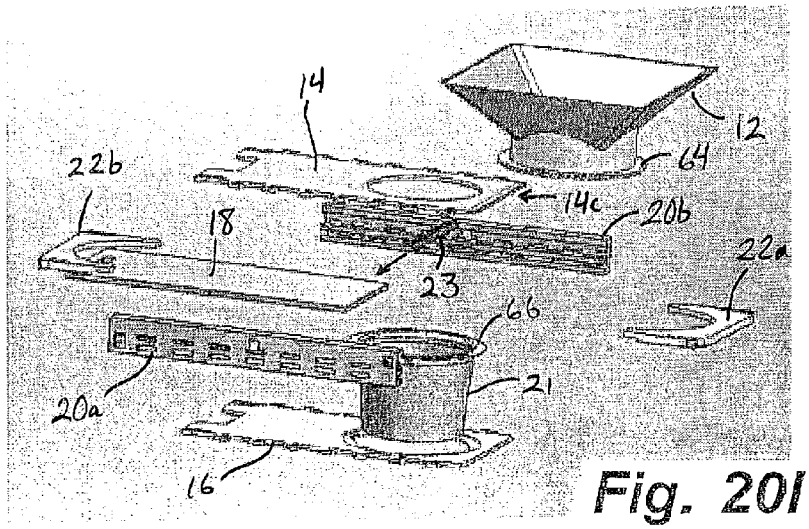

Once support rails 20*a*, 20*b* are removed from the upper and lower panels, the upper panel 14, lower panel 16, and movable panel 18 may be separated from one another as shown in FIGS. 20F and 20G. Once the upper flange 66 of conduit 21 is no longer blocked by distal end portion 18*c* of movable valve panel 18 (compare FIG. 200 to FIG. 20F), conduit 21 may be removed from lower panel 16 by lifting the conduit 21 as shown in FIG. 20H. Optionally, such as if conduit 21 is locked to lower panel 16 via engagement of projections 68 with circular shelf portion 46 of lower panel 16, the conduit 21 is initially rotated until projections 68 align with notches 44*a*, 44*b*, before lifting conduit 21 upwardly out of opening 34 and away from lower panel 16. Once distal end portion 14*c* of upper panel 14 is exposed via separation of support rails 20*a*, 20*b*, dust seal 23 may be slid laterally outwardly away from the upper panel 14, such as shown in FIG. 20I. Thus, the slide valve assembly can be removed from the hopper lower end portion and disassembled without the use of tools, and without the use of separate mechanical fasteners. It will be appreciated that, although the disassembly method or procedure is primarily described as not requiring the use of tools, a screwdriver or other small tool could be used to aid in depressing the engaging portions to move them out of engagement with the support rails.

Slide valve assembly 10 may be reassembled and reattached to hopper lower end portion 12 in substantially the reverse order of removal and disassembly, described above. However, rather than depressing engaging portions of respective resilient locking projections of the upper panel 14, lower panel 16, and collar retainer halves, 22*a*, 22*b*, the ramped surfaces of the engaging portions allow the upper panel 14, lower panel 16 and collar retainer halves 22*a*, 22*b* to "snap" into engagement with respective openings or apertures in the support rails 20*a*, 20*b*, without need to manually depress the engaging portions of the resilient locking projections of these components. Thus, the slide valve assembly can be snapped together without the use of tools, and without the use of separate mechanical fasteners.

It will be appreciated that although the terms "upper" and "lower" are used throughout the specification, these terms are merely used to indicate relative positioning of various components as shown in the drawings. For example, it is envisioned that the hopper could have a dispensing portion along a side, such as for auger-driven dispensing of product, with the slide valve assembly mounted substantially perpendicularly to the orientation shown in the drawings, without departing from the spirit and scope of the present invention. It is further envisioned that the slide valve assembly could be readily adapted for dispensing fluids from a hopper or pipe, such as by adjusting tolerances and/or adding seals as appropriate to create fluid-tight connections to the hopper or pipe dispensing portion, and within the slide valve assembly itself.

Accordingly, the present invention provides a slide valve assembly that is readily assembled and disassembled, without the use of special tools, and which does not include separate fasteners that could be prone to detachment or loosening and risk falling into the goods that are dispensed through the slide valve assembly.

Changes and modifications in the specifically described embodiments can be carried out without departing from the principles of the present invention which is intended to be limited only by the scope of the appended claims, as interpreted according to the principles of patent law, including the doctrine of equivalents.

The invention claimed is:

1. A slide valve for selectively dispensing dry bulk goods from a hopper, said slide valve comprising:

at least one panel having opposite side portions and defining an opening;

a movable valve panel disposed near said at least one panel, said movable valve panel having opposite side portions;

at least one panel having opposite side portions;

a collar retainer disposed above said at least one panel and defining an opening for receiving a dispensing portion of a hopper, said collar retainer having opposite side portions;

a pair of spaced support rails, each of said support rails coupled to a respective one of said side portions of each of said at least one panel and said collar retainer, without the use of separate mechanical fasteners; and wherein said movable valve panel is positionable between a closed position in which the dispensing portion of the hopper is blocked and an open position in which the dispensing portion of the hopper is unblocked.

2. The slide valve of claim 1, wherein said collar retainer comprises a pair of collar retainer halves, each of which defines approximately one-half of said opening of said collar retainer, and which are separable from one another to disengage the dispensing portion of the hopper.

3. The slide valve claim 2, wherein each of said collar retainer halves comprises at least one resilient locking projection configured to releasably and lockably engage at least one of said support rails.

4. The slide valve of claim 1, wherein each of said opposite side portion of said at least one panel comprises at least one non-removable retaining element, and wherein each of said support rails comprises at least one mounting element for securely and releasably engaging said at least one non-removable retaining element along each opposite side portion of said at least one panel.

5. The slide valve of claim 4, wherein said at least one panel comprises at least one resilient locking projection configured to releasably and lockably engage at least one of said support rails so that when said resilient locking projection lockably engages said at least one of said support rails, said resilient locking projection prevents movement of said at least one panel relative to said support rails.

6. The slide valve of claim 4, wherein said at least one non-removable retaining element of said at least one panel comprises a plurality of L-shaped projections along each opposite side portion of said at least one panel, and wherein said at least one mounting element of each of said support rails comprises at least one row of apertures, said apertures configured to receive said L-shaped projections.

7. The slide valve of claim 6, wherein said L-shaped projections are unitarily formed with said at least one panel.

8. The slide valve of claim 6, wherein said at least one panel comprises an upper panel positioned above said movable slide panel, and a lower panel positioned below said movable slide panel.

9. The slide valve of claim 8, wherein said upper panel and said lower panel each define a respective opening that is aligned with the dispensing portion of the hopper.

10. The slide valve of claim 9, further comprising a conduit removably positioned in said opening of said lower panel, said conduit in fluid communication with said opening of said upper panel and the dispensing portion of the hopper when said movable valve panel is in the open position.

11. The slide valve of claim 10, wherein said conduit is supported by said lower panel in a manner that said conduit is only removable from said lower panel when said upper panel is first removed from between said support rails and when said slide valve is detached from the hopper.

12. The slide valve of claim 8, wherein each of said support rails comprises an upper channel and a lower channel with a row of said apertures arranged along each of said upper and lower channels, each of said upper channel and lower channel configured to receive one of said opposite side portions of said upper panel and said lower panel, respectively.

13. The slide valve of claim 12, wherein each of said support rails comprises a middle flange, between said upper channel and said lower channel, for slidably engaging opposite side portions of said movable valve panel.

14. The slide valve of claim 1, further in combination with a hopper configured to store and dispense bulk goods.

15. A method of removing a slide valve from a hopper, comprising:

providing a hopper having a dispensing portion;

providing a slide valve including an upper panel, a movable slide panel below the upper panel, each of the panels supported between a pair of support rails, and a two-piece collar retainer coupled between the support rails and disposed above the upper panel, the two-piece collar defining an opening for coupling to the dispensing portion of the hopper;

de-coupling a first piece of the two-piece collar retainer from the support rails and the dispensing portion of the hopper; and de-coupling the upper panel, the slide panel, and the support rails from the dispensing portion of the hopper, wherein said step of de-coupling the first piece of the two-piece collar comprises disengaging at least one resilient locking projection of the first piece from locking engagement with at least one of the support rails, and moving the first piece of the two-piece collar laterally away from the dispensing portion of the hopper, and wherein said step of de-coupling the upper panel, the slide panel, and the support rails comprises de-coupling the upper panel, the slide panel, the support rails, and a second piece of the two-piece collar retainer, together as a unit, from the dispensing portion of the hopper.

16. A method of removing a slide valve from a hopper, comprising:

providing a hopper having a dispensing portion;

providing a slide valve including an upper panel, a movable slide panel below the upper panel, each of the panels supported between a pair of support rails, and a two-piece collar retainer coupled between the support rails and disposed above the upper panel, the two-piece collar defining an opening for coupling to the dispensing portion of the hopper;

de-coupling a first piece of the two-piece collar retainer from the support rails and the dispensing portion of the hopper; and de-coupling the upper panel, the slide panel, and the support rails from the dispensing portion of the hopper, wherein said step of de-coupling the upper panel, the slide panel, and the support rails comprises de-coupling the upper panel, the slide panel, and the support rails together as a unit from the dispensing portion of the hopper.

* * * * *